US010945512B2

(12) United States Patent
Vacheron et al.

(10) Patent No.: US 10,945,512 B2
(45) Date of Patent: Mar. 16, 2021

(54) MEANS FOR LOCKING A COSMETIC CASE

(71) Applicant: REBOUL S.A.S., Chavanod (FR)

(72) Inventors: Frederic Vacheron, Menthon Saint Bernard (FR); Michel Domy, Cran Gevrier (FR)

(73) Assignee: REBOUL S.A.S.

( * ) Notice: Subject to any disclaimer, the term of this patent is extended or adjusted under 35 U.S.C. 154(b) by 190 days.

(21) Appl. No.: 16/335,111

(22) PCT Filed: Sep. 20, 2017

(86) PCT No.: PCT/FR2017/052514
§ 371 (c)(1),
(2) Date: Apr. 26, 2019

(87) PCT Pub. No.: WO2018/055286
PCT Pub. Date: Mar. 29, 2018

(65) Prior Publication Data

US 2020/0085167 A1 Mar. 19, 2020

(30) Foreign Application Priority Data

Sep. 21, 2016 (FR) ..... 1670542

(51) Int. Cl.
*B65D 85/72* (2006.01)
*A45D 40/12* (2006.01)
(Continued)

(52) U.S. Cl.
CPC ..... *A45D 40/12* (2013.01); *A45D 40/06* (2013.01); *A45D 2040/0025* (2013.01)

(58) Field of Classification Search
CPC ..... A45D 40/02; A45D 40/06; A45D 40/12; A45D 2040/0025; Y10S 401/01
(Continued)

(56) References Cited

U.S. PATENT DOCUMENTS 2,168,876 A * 8/1939 Noyack ..... A45D 40/02 72/326
2,753,991 A * 7/1956 Sherman ..... A45D 40/16 206/385
(Continued)

FOREIGN PATENT DOCUMENTS

FR 2 670 998 7/1992
WO WO 95/01743 1/1995

OTHER PUBLICATIONS

International Search Report (with English translation) dated Jan. 12, 2018 for International application No. PCT/FR2017/052514.
(Continued)

*Primary Examiner* — Luan K Bui
(74) *Attorney, Agent, or Firm* — Fay Sharpe LLP

(57) ABSTRACT

A rotating cosmetic case including an outer metal jacket (1) fitted and mechanically retained to a sheath of synthetic material, at the same time by at least one rotational lock and at least one tensile lock. A rotational lock may include a cut-out (5) opening outwards at the lower end of the cylindrical wall of the metal jacket (1), this cut-out (5) being mounted in conjunction with a molded projection in the sheath, while the tensile lock may include at least one aperture (7) in the lower part of the cylindrical wall of the metal sheath (1) defining, with the lower end of the sheath (1), a wall portion (8) directed inwards with respect to a housing located in the sheath.

20 Claims, 3 Drawing Sheets

(51) Int. Cl.
*A45D 40/06* (2006.01)
*A45D 40/00* (2006.01)

(58) Field of Classification Search
USPC ..... 206/1.5, 385; 401/77, 78, 86, 88, 96, 401/DIG. 1
See application file for complete search history.

(56) References Cited

U.S. PATENT DOCUMENTS

| | | | | |
|---|---|---|---|---|
| 3,758,218 | A | 9/1973 | Pfrommer et al. | |
| 4,815,485 | A * | 3/1989 | Morel | A45D 40/02 132/318 |
| 4,961,663 | A | 10/1990 | Iwamoto et al. | |
| 6,036,387 | A * | 3/2000 | Gueret | A45D 40/06 401/78 |
| 10,781,030 | B2 * | 9/2020 | Abrams | B65D 83/0005 |
| 2003/0042161 | A1 * | 3/2003 | Iwamoto | A45D 40/06 206/385 |
| 2008/0041747 | A1 * | 2/2008 | Mihara | A45D 40/06 206/385 |
| 2015/0208785 | A1 * | 7/2015 | Holloway | A45D 40/06 401/78 |

OTHER PUBLICATIONS

Written Opinion of the International Searching Authority (with English translation) dated Jan. 12, 2018 for International application No. PCT/FR2017/052514.

International Preliminary Report on Patentability (with English translation) dated Mar. 26, 2019 for International application No. PCT/FR2017/052514.

* cited by examiner

MEANS FOR LOCKING A COSMETIC CASE

CROSS-REFERENCE TO RELATED APPLICATION

This application is the U.S. National Phase of PCT International Application No. PCT/FR2017/052514 filed Sep. 20, 2017, which claims priority from French Application No. 1670542 filed Sep. 21, 2016.

FIELD

The present invention relates to the mechanical restraint in rotation and tensile of constituent elements of a rotating cosmetic case, of the type used to contain cosmetic products, such as a stick of lipstick or lip creams.

BACKGROUND

A rotating cosmetic case is generally equipped with a removable cover, which is assembled in correspondence with a lower packaging. The lower packaging plays the role of cylinder covering facilitating the gripping of the case, and is fitted on a mechanism consisting of a slider receiving a stick of lipstick or lip balms, which usually comes to be embedded in a sheath, which is itself encased in a spiral envelope. The slider is equipped with lugs engaged in the slides of the sheath and extending into the helical grooves of the spiral envelope. The rotation of the lower packaging drives the cursor in a simultaneous movement of rotation and translation, allowing access to the lipstick or lip balms.

In order to bring aesthetics to the product and comfort of handling, the concentric elements of synthetic material of the rotating mechanism are embedded in a metal sheath. The fastening of this assembly is generally provided by glue.

The use of glue additionally generates problems related to its handling, as well as the application of a precise amount to avoid smears and the creation of glue beading that can interfere with the proper functioning of the mechanism, setting times of the glue and evaporation of relatively long volatile products, which requires an organization of the particular assembly line and reduces the rate of production.

In order to solve the drawbacks inherent in the use of glue, mechanical means for retaining the metal jacket with a sheath made of synthetic material have been developed.

Effective mechanical fastening of these elements is required to limit the problems of separation of the metal jacket by excessive and repetitive pulling and rotating, related to the handling of a case, including removal of the protective cover or excessive stress the mechanism at the end of the process of movement.

One commonly used means is the stamping of the metal sheath against a synthetic sheath. However, this mechanical fastening, although satisfactory in terms of maintenance, generates a risk of deterioration of the rotating mechanism, which is not acceptable for a quality tube.

SUMMARY

The present invention provides a means of locking in rotation and tensile, to overcome the aforementioned drawbacks.

Thus, a rotating cosmetic case according to the invention comprises an outer metal jacket, fitted and mechanically fastened at the same time to a plastic sheath by at least one rotational means of locking and at least one tensile means of locking, a rotational means of locking consisting of a cut-out opening outwards at the lower end of the cylindrical wall of the metal jacket, the cut-out being mounted in collaboration with a molded projection in the sheath, while the tensile means of locking consists of at least one orifice in the lower part of the cylindrical wall of the metal jacket, delimiting with the lower end of the latter, an inwards facing wall portion facing a housing located in the sheath.

According to one embodiment, the cut-out is trapezoidal.

According to one feature, a transverse face of the cut-out arranged radially relative to the cylindrical wall of the metal sleeve abuts against a face, also arranged radially from the projecting profile of the sheath.

Note that the wall portion is directed inwards and has at least one recess, while at least one recess has a protruding profile.

It should be noted that the upper end of the inwards directed wall portion of the metal jacket is in contact with the upper end of the housing of the sheath.

According to a complementary feature, the lower end of the inwards directed wall portion of the metal jacket coincides with the lower end of the housing of the sheath.

It should also be noted that the height of one wall portion is lower than the height of one housing.

According to one embodiment, two means of tensile locking are located diametrically opposite.

According to another feature, the sheath is a spiral envelope which comprises at least one helical groove corresponding to a first zone, that we shall qualify as a negative zone, and a second zone that we shall qualify as a positive zone, corresponding to the zone arranged between two portions of helical groove, while at least one housing is located in correspondence with at least one positive zone.

Other features and advantages of the invention will become apparent from the description which follows, with reference to the accompanying drawings which are given by way of non-limiting examples.

BRIEF DESCRIPTION OF THE DRAWINGS

FIGS. 1*a* to 3*b* are views of a cosmetic case and its constituent elements, according to one embodiment.

FIGS. 1*a* and 1*b* are front views of a mechanism rotating from two angular positions.

FIG. 3 is a perspective view of a metal jacket.

DETAILED DESCRIPTION

Figure 1A:
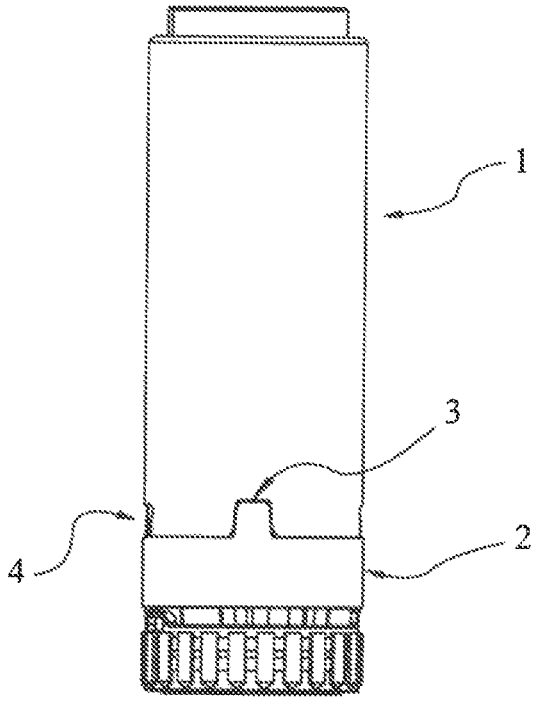
Figure 1B:
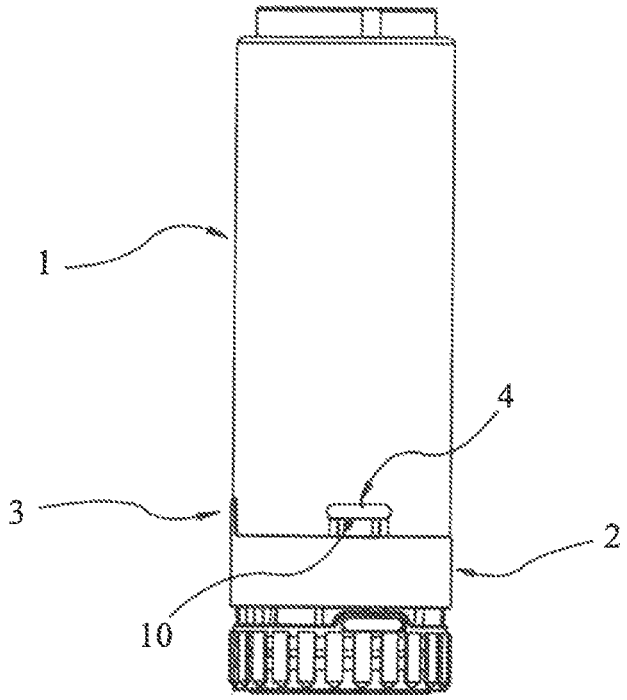
Figure 2A:
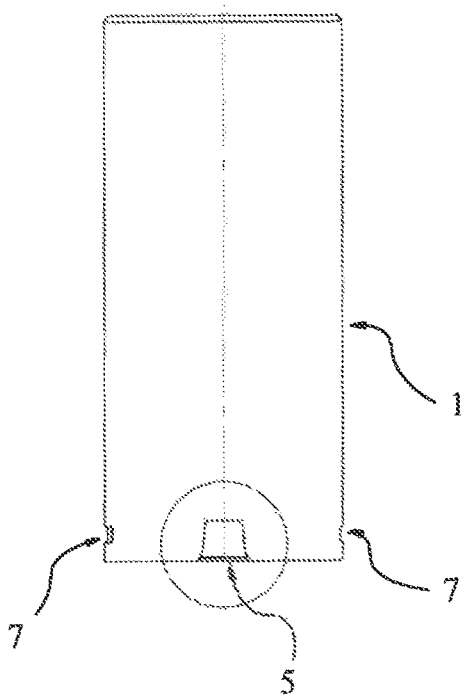
FIGS. 2*a* and 2*b* are front views of a metal jacket from two angular positions.
Figure 2B:
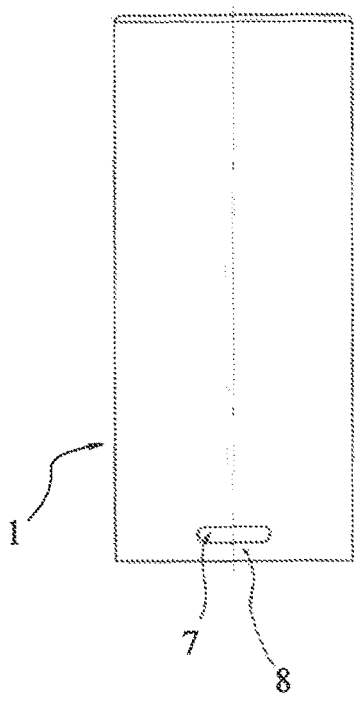
Figure 2C:
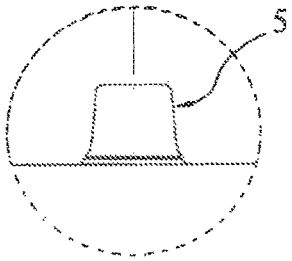
FIG. 2*c* is a magnification view of FIG. 2*a*.
Figure 3:
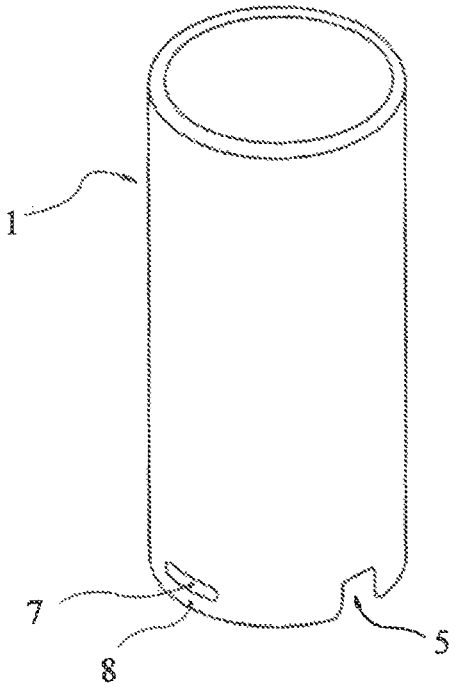
Figure 4A:
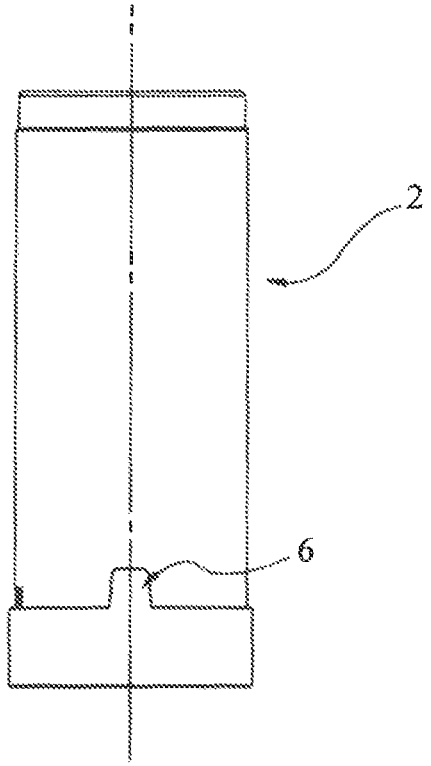
FIGS. 4*a* and 4*b* are front views of a spiral envelope according to two angular positions.
Figure 4B:
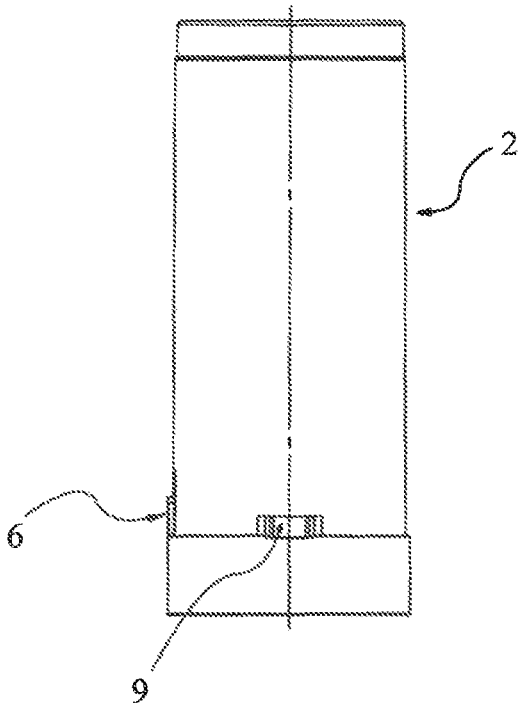

Thus, a cosmetic case according to the invention comprises at least one rotational means of locking (3), independent of at least one tensile means of locking (4) of a metal jacket (1) and a sheath (2) of synthetic material.

The separation of these two means of locking (3, 4) makes it possible to optimize their effects by optimizing each of the means separately.

According to the embodiment illustrated, the cosmetic case comprises a rotational means of locking (3) and two tensile means of locking (4), arranged diametrically opposite to optimize the distribution of forces involved during We shall add that the means of locking in rotation (3) and in translation (4) according to the invention, are provided by means of locking by shape cooperation located both on the metal jacket (1) and on the sheath (2) of synthetic material.

The rotational means of locking (3) centers around the cooperation of at least two abutment faces arranged radially or substantially radially with respect to the concentric elements on which they are carried, while the tensile means of locking (4) is introduced by the contact of at least two faces also abutting, but arranged parallel or substantially parallel to the bottom of the cosmetic case, that is to say perpendicular to the axis of rotation of the rotating mechanism.

According to the illustrated embodiment, the rotational means of locking (3) consists of the collaboration of a cut-out (5) made at the lower end of the cylindrical wall of the metal jacket (1), with a molded projection (6) in the sheath (2), such that at least one respective side face of the cut-out (5) and the molded projection (6) abut one against the other, while each of the lateral faces is oriented so that their respective planes are oriented radially or substantially radially, namely making an acute angle with the general axis of rotation of the mechanism.

It is to be noted that the general profile of a molded projection (6) is intended not to exceed the outer profile of the metal jacket (1), namely the outer profile of the molded projection (6) matches that of the metal jacket (1).

Preferably, the abutment faces of the cut-out (5) and the molded projection (6) are at an angle to the general axis of rotation of the mechanism, between 1 and 45°, preferably between 1 and 20°, more preferably 5°, as illustrated.

This orientation of the faces—one against the other—allows a facilitated insertion of the cut-out (5) at the periphery of the molded projection (6), during the fitting of the metal jacket (1) on the sheath (2) of synthetic material.

According to one feature, the cut-out (5) is trapezoidal.

According to the preceding feature, the lower ends of the trapezoidal cut-out (5) are tapered, that is, rounded.

Note that the molded projection (6) has a shape corresponding to that of the cut-out (5), namely that if the cut-out (5) is trapezoidal, the molded projection (6) is also, so that their respective lateral faces come into contact and in abutment, blocking all rotational ranges.

The collaboration of the cut-out (5) and the molded projection (6) makes it possible to form a rotational means of locking (3) in both directions of rotation of the turning mechanism, in particular during end-of-stroke stresses during both the ascent of the descent of the stick of cosmetic.

Recall that the rotating cosmetic case also comprises at least one translation locking (4) means.

According to the illustrated embodiment, translational means of locking (4) is provided by a wall portion (8) located at the lower end of the metal jacket (1), which is curved inwards and comes embedding in a suitable housing (9) arranged in the sheath (2) made of synthetic material.

The wall portion (8) is formed by an orifice (7) located substantially at the lower end of the metal jacket (1). The wall portion (8) is therefore delimited by at least the lower end of the orifice (7) and the lower end of the metal jacket (1). The shape of this wall portion (8) is preferably longitudinal and thin, as it is intended to be flexible to allow its torsion inwards without damaging the overall profile of the metal jacket (1).

According to the illustrated embodiment, an orifice (7) having an oblong shape, so that the wall portion (8) provides a rectilinear part, but it could be otherwise—an orifice (7) in a parallelepiped shape.

Note that the wall portion (8) has at least one recess (10), preferably at least two recesses (10), whose profile(s) is/are advantageously projecting.

It should be noted that the upper face(s) of the wall portion (8) are in contact, or even placed under stress against the upper face of the housing (9), when the metal sleeve (1) is fitted together around the sheath (2).

According to a complementary feature, the height of a wall portion (6) is less than the height of a housing (9), in order to limit the force to be applied to create a recess (10), without altering the cylindrical profile of the outer jacket.

According to the illustrated embodiment, the sheath (2) of synthetic material is a spiral envelope, which comprises at least one helical groove corresponding to a first zone, which will be described as a negative zone, and a second zone which will be described as a positive zone, corresponding to the zone arranged between two portions of helical groove, while at least one housing (9) is located in correspondence with at least one positive zone.

The invention claimed is:

1. A rotating cosmetic case comprising an outer metal jacket (1), mechanically retained on a sheath (2) of synthetic material by at least one rotational means of locking (3) and at least one tensile means of locking (4), said rotational means of locking (3) comprising a cut-out (5) opening outwards at a lower end of a cylindrical wall of the metal jacket (1), said cut-out (5) being mounted in cooperation with a molded projection (6) formed in the sheath (2), while the tensile means of locking (4) comprises a wall portion (8) defined between the lower end of the metal jacket (1) and an orifice (7) defined in the metal jacket (1), said wall portion (8) engaging a housing (9) located in the sheath (2).

2. The rotating cosmetic case according to claim 1, wherein the cut-out (5) is trapezoidal.

3. The rotating cosmetic case according to claim 1, wherein a transverse face of the cut-out (5) arranged radially with respect to the cylindrical wall of the metal jacket, abuts a face also arranged radially from the molded projection (6) of the sheath (2).

4. The rotating cosmetic case according to claim 1, wherein the wall portion (8) faces inwards and has at least one recess (10).

5. The rotating cosmetic case according to claim 4, wherein the at least one recess (10) has a projecting profile.

6. The rotating cosmetic case according to claim 1, wherein an upper end of the wall portion (8) directed towards the inside of the metal jacket (1) is in contact with the upper end of the housing (9) of the sheath (2).

7. The rotating cosmetic case according to claim 1, wherein the lower end of the wall portion (8) of the metal jacket (1) directed inwards, coincides with a lower end of the housing (9) of the sheath (2).

8. The rotating cosmetic case according to claim 1, wherein a height of the wall portion (8) is less than a height of the housing (9).

9. The rotating cosmetic case according to claim 1, wherein said rotating cosmetic case comprises two of said means of tensile locking (4) which are located diametrically opposite with respect to each other.

10. The rotating cosmetic case according to claim 1, wherein the sheath (2) is a spiral envelope, which comprises at least one helical groove corresponding to a first zone, which will be described as a negative zone, and a second zone that will be described as a positive zone, corresponding to the zone arranged between two portions of helical groove, while the housing (9) is located in correspondence with the positive zone.

11. The rotating cosmetic case according to claim 2, wherein a transverse face of the cut-out (5) arranged radially with respect to the cylindrical wall of the metal jacket, abuts a face also arranged radially from the molded projection (6) of the sheath (2).

12. The rotating cosmetic case according to claim 1, wherein the wall portion (8) curves inwardly and has at least one recess (10).

13. The rotating cosmetic case according to claim 12, wherein the at least one recess (10) has a projecting profile.

14. The rotating cosmetic case according to claim 2, wherein an upper end of the wall portion (8) directed towards the inside of the metal jacket (1) is in contact with the upper end of the housing (9) of the sheath (2).

15. The rotating cosmetic case according to claim 3, wherein an upper end of the wall portion (8) directed towards the inside of the metal jacket (1) is in contact with the upper end of the housing (9) of the sheath (2).

16. The rotating cosmetic case according to claim 4, wherein an upper end of the wall portion (8) directed towards the inside of the metal jacket (1) is in contact with the upper end of the housing (9) of the sheath (2).

17. The rotating cosmetic case according to claim 5, wherein an upper end of the wall portion (8) directed towards the inside of the metal jacket (1) is in contact with the upper end of the housing (9) of the sheath (2).

18. The rotating cosmetic case according to claim 7, wherein the lower end of the wall portion (8) of the metal jacket (1) directed inwards, coincides with a lower end of the housing (9) of the sheath (2).

19. A rotating cosmetic case comprising:

an outer metal jacket (1) mechanically retained on a sheath (2) of synthetic material by both a rotational lock (3) and a tensile lock (4);

said rotational lock (3) comprising a cut-out (5) that opens outwardly through a lower end of a cylindrical wall of the metal jacket (1), said cut-out (5) being mounted in cooperation with a molded projection (6) formed in the sheath (2) such that said molded projection (6) is located in said cut-out (5);

said tensile lock (4) comprising: (i) an orifice (7) defined in the lower end of the metal jacket (1); and (ii) a wall portion (8) of the metal jacket (1) defined between the orifice (7) and the lower end of the metal jacket (1);

said wall portion (8) of said tensile lock (4) curved inwardly such that it defines a recess (10) and such that said wall portion (8) is received in and engaged with a housing (9) located in the sheath (2).

20. The rotating cosmetic case as set forth in claim 19, wherein said inwardly curved wall portion (8) of said tensile lock (4) comprises an upper face that is engaged with an upper face of the housing (9) located in the sheath (2).

* * * * *